US012623821B2

(12) United States Patent
Zhang

(10) Patent No.: US 12,623,821 B2
(45) Date of Patent: May 12, 2026

(54) BOX

(71) Applicant: Hebei Fenger Intelligent Technology Co., Ltd, Shijiazhuang (CN)

(72) Inventor: Jianzhong Zhang, Handan (CN)

(73) Assignee: Hebei Fenger Intelligent Technology Co., Ltd, Shijiazhuang (CN)

( * ) Notice: Subject to any disclaimer, the term of this patent is extended or adjusted under 35 U.S.C. 154(b) by 127 days.

(21) Appl. No.: 18/327,053

(22) Filed: Jun. 1, 2023

(65) Prior Publication Data

US 2023/0303297 A1 Sep. 28, 2023

(51) Int. Cl.

| | |
|---|---|
| ***B65D 53/02*** | (2006.01) |
| ***B65D 25/24*** | (2006.01) |
| ***B65D 43/02*** | (2006.01) |
| ***B65D 51/16*** | (2006.01) |
| ***B65D 51/24*** | (2006.01) |
| ***B65D 63/10*** | (2006.01) |
| ***B65D 81/26*** | (2006.01) |

(52) U.S. Cl.

CPC ..... *B65D 53/02* (2013.01); *B65D 25/24* (2013.01); *B65D 43/0214* (2013.01); *B65D 51/1683* (2013.01); *B65D 51/246* (2013.01); *B65D 63/109* (2013.01); *B65D 81/261* (2013.01); *B65D 2205/02* (2013.01); *B65D 2251/205* (2013.01); *B65D 2543/00194* (2013.01); *B65D 2543/00564* (2013.01); *B65D 2543/00972* (2013.01)

(58) Field of Classification Search

CPC B65D 53/02; B65D 43/0214; B65D 51/1683; B65D 2543/00564; B65D 2543/00972

USPC ..... 206/212

See application file for complete search history.

(56) References Cited

U.S. PATENT DOCUMENTS

| | | | | |
|---|---|---|---|---|
| 3,378,177 | A * | 4/1968 | Gran | A01J 9/00 220/759 |
| 3,437,254 | A * | 4/1969 | Bergstrom | B65D 15/08 220/624 |
| 4,003,709 | A * | 1/1977 | Eaton | G01N 31/22 422/86 |
| 4,223,800 | A * | 9/1980 | Fishman | B65D 43/022 220/521 |
| 5,065,885 | A * | 11/1991 | Scaroni | B65D 45/22 220/326 |
| 5,181,626 | A * | 1/1993 | Daenen | B65D 43/021 220/255 |
| 5,868,273 | A * | 2/1999 | Daenen | B65D 43/0212 220/780 |

(Continued)

*Primary Examiner* — Ernesto A Grano
*Assistant Examiner* — Symren K Sanghera
(74) *Attorney, Agent, or Firm* — Hemisphere Law, PLLC

(57) ABSTRACT

The present invention discloses a box, comprising: a box body; a box cover, wherein the box cover is covered at an opening of the box body, a limiting cylinder is formed on the bottom end of the box cover near an outer edge, and the bottom end of the box cover is provided with an annular clamping groove located at the outer side of the limiting cylinder; an elastic sealing ring which comprises: a top sealing ring, an inserting flange; a middle sealing cylinder, and the middle sealing cylinder is sleeved on the outer cylinder wall of the limiting cylinder; and a bottom sealing ring, and the outer edge of the bottom sealing ring is in compression sealing contact with the inner wall of the box body.

9 Claims, 7 Drawing Sheets

(56) References Cited

U.S. PATENT DOCUMENTS

| | | | | |
|---|---|---|---|---|
| 5,947,320 | A * | 9/1999 | Bordner | B65D 47/121 220/803 |
| 5,967,363 | A * | 10/1999 | Allen | B44D 3/128 220/733 |
| 8,899,443 | B2 * | 12/2014 | Soibel | B65D 43/0233 220/795 |
| 2014/0061193 | A1 * | 3/2014 | Sudakoff | B65D 43/0218 220/628 |
| 2016/0167863 | A1 * | 6/2016 | Han | B65D 51/1644 220/256.1 |
| 2017/0088307 | A1 | 3/2017 | Roozrokh | |
| 2017/0253391 | A1 | 9/2017 | Wichowski | |
| 2018/0162611 | A1 * | 6/2018 | Li | B65D 51/243 |
| 2018/0265263 | A1 * | 9/2018 | Li | B65D 43/0202 |
| 2019/0233177 | A1 * | 8/2019 | Han | B65D 81/3818 |
| 2020/0165040 | A1 * | 5/2020 | Liu | B65D 43/0218 |
| 2020/0262619 | A1 * | 8/2020 | de Sicart | B65D 45/16 |
| 2022/0089316 | A1 | 3/2022 | Huang | |
| 2022/0411145 | A1 * | 12/2022 | Shao | B65D 47/0804 |
| 2023/0234759 | A1 * | 7/2023 | McNamara | B65D 47/248 215/307 |
| 2023/0373695 | A1 * | 11/2023 | Zhang | B65D 51/1683 |

* cited by examiner

BOX

TECHNICAL FIELD

The present invention relates to the technical field of boxes for household goods, more particularly to a box.

BACKGROUND

In the prior art, CN108928554A—a fresh-keeping box comprises a box body. A box cover is installed at the top end of the box body; an edge is arranged outside the box body; the upper part of the box body is provided with an annular bulge; an annular clamping groove is arranged outside the box cover; an annular silicone pad is arranged inside the annular clamping groove; the box body is matched and connected with the box cover through the annular bulge and the annular clamping groove; an inverted plate is arranged outside the box cover; the inverted plate is buckled on the edge of the box body; a rice placing groove, a soup placing groove and a dish placing groove are arranged inside the box body; foot pads are installed at the bottom end of the box body; storage rooms are arranged inside the foot pads; and one end of the foot pads is provided with a plug matched with the storage rooms. In the present invention, the annular bulge and the annular clamping groove are arranged and the annular silicone pad is arranged inside the annular clamping groove so that the sealing effect of the box body and the box cover is enhanced; and chopsticks and spoons are arranged respectively in the storage rooms of the two foot pads, so as to facilitate the carrying of the chopsticks and the spoons.

However, in the above fresh-keeping box, because dirt may be attached to the surface of the annular silicone pad with a sealing effect after long-term use, and because the annular silicone pad is entirely embedded in the annular clamping groove on the box cover when the annular silicone pad needs to be taken out for washing or disinfection, it is difficult to take out the annular silicone pad from the annular clamping groove and is inconvenient to use. Moreover, the annular silicone pad in the fresh-keeping box can only achieve one seal, and the sealing effect is poor.

Therefore, the problem to be urgently solved by those skilled in the art is how to provide a box which is easy for separating a sealing ring from the box cover, convenient for disassembly and assembly of the sealing ring and good in sealing performance.

SUMMARY

In view of this, the present invention provides a box which is easy for separating a sealing ring from a box cover, convenient for disassembly and assembly of the sealing ring and good in sealing performance.

To achieve the above purpose, the present invention adopts the following technical solution:

A box comprises:

a box body, wherein the top end of the box body is open;

a box cover, wherein the box cover is covered at an opening of the box body, a limiting cylinder is formed on the bottom end of the box cover near an outer edge, and the bottom end of the box cover is provided with an annular clamping groove located at the outer side of the limiting cylinder;

an elastic sealing ring which comprises:

a top sealing ring, wherein the top sealing ring is crimped between the open end of the box body and the bottom end surface of the box cover, an inserting flange is integrally formed at the top end of the top sealing ring, and the inserting flange is clamped in the annular clamping groove;

a middle sealing cylinder, wherein the outer wall of a cylinder port of the top end of the middle sealing cylinder is integrally connected with a ring port of the top sealing ring, and the middle sealing cylinder is sleeved on the outer cylinder wall of the limiting cylinder;

a bottom sealing ring, wherein a ring port of the bottom sealing ring is integrally formed and connected with the outer wall of the cylinder port of the bottom end of the middle sealing cylinder, and the outer edge of the bottom sealing ring is in compression sealing contact with the inner wall of the box body.

It can be known from the above technical solution that compared with the prior art, the present invention discloses and provides a box. When the box cover is covered on the box body, the bottom sealing ring and the inner wall of the box body are in compression sealing contact as a first seal, and the top sealing ring is pressed between the box cover and the box body and serves as a second seal. Therefore, the elastic sealing ring of the box body can play a role of double seals to improve the sealing performance of the box body. Moreover, the limiting cylinder plays a supporting and limiting role on the middle sealing cylinder. When the box cover is buckled, it is convenient for the bottom sealing ring to exert extrusion force on the inner wall direction of the box body, so as to achieve tight contact sealing with the inner wall of the box body and ensure the sealing effect. In addition, the elastic sealing ring is exposed outside of the box cover, which is easy to disassemble and assemble the elastic sealing ring and the box cover, so as to facilitate the washing and disinfection of the elastic sealing ring, and the elastic sealing ring is clamped in the annular clamping groove through the inserting flange, so that the elastic sealing ring is fixed more stably.

Further, a plurality of storage boxes for classifying and containing food are placed in the box body.

The beneficial effects produced by adopting the above technical solution are: when many types of food need to be classified and contained, a corresponding number of storage boxes can be placed in the box body, which is convenient to partition and contain the food. Further, the box body is made of plastics or stainless steel or glass.

Further, the top end surface of the box cover is provided with a concave accommodating groove, the groove bottom of the accommodating groove is provided with an installing hole and a vacuuming vent hole, and the vacuuming vent hole is located on one side of the installing hole;

the box further comprises an air hole lifting plug arranged on the installing hole, and the air hole lifting plug comprises:

a lifting block, wherein the lifting block is arranged in the accommodating groove;

a sealing cover, wherein the top end of the sealing cover is integrally formed and connected with the bottom end of the lifting block and the bottom end of the sealing cover and the groove bottom of the accommodating groove are in tight sealed contact for sealing the vacuuming vent hole;

a guide connecting block, wherein the guide connecting block is penetrated in the installing hole, the top end of the guide connecting block is integrally formed and connected with the bottom end of the sealing cover, the bottom end of the guide connecting block is integrally formed and connected with an anti-falling lug boss, and the anti-falling lug boss is located below the bottom end surface of the box cover.

The beneficial effects produced by adopting the above technical solution are: the vacuuming vent hole can be used for vacuuming the air inside the box body, to improve the storage quality of the food in the box body. When the cover needs to be opened, the lifting block is pulled up, to separate the sealing cover from the accommodating groove. Even if the atmospheric pressure inside the box body is communicated with outside atmospheric pressure through the vacuuming vent hole, the atmospheric pressure inside and outside the box body is the same, which is easy to open the box cover.

Further, the bottom end of the box cover is provided with a spoon for holding food or a ruler for determining the amount of food taken.

The beneficial effects produced by adopting the above technical solution are: it is easy to disassemble and assemble the spoon or the ruler on the box cover rapidly, and the silicone ring has certain elasticity, and can be clamped and fixed on the clamping bulge on the box cover through the elasticity, to ensure the stability of the spoon or the ruler on the box cover and prevent the spoon or the ruler from falling off the box cover easily.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
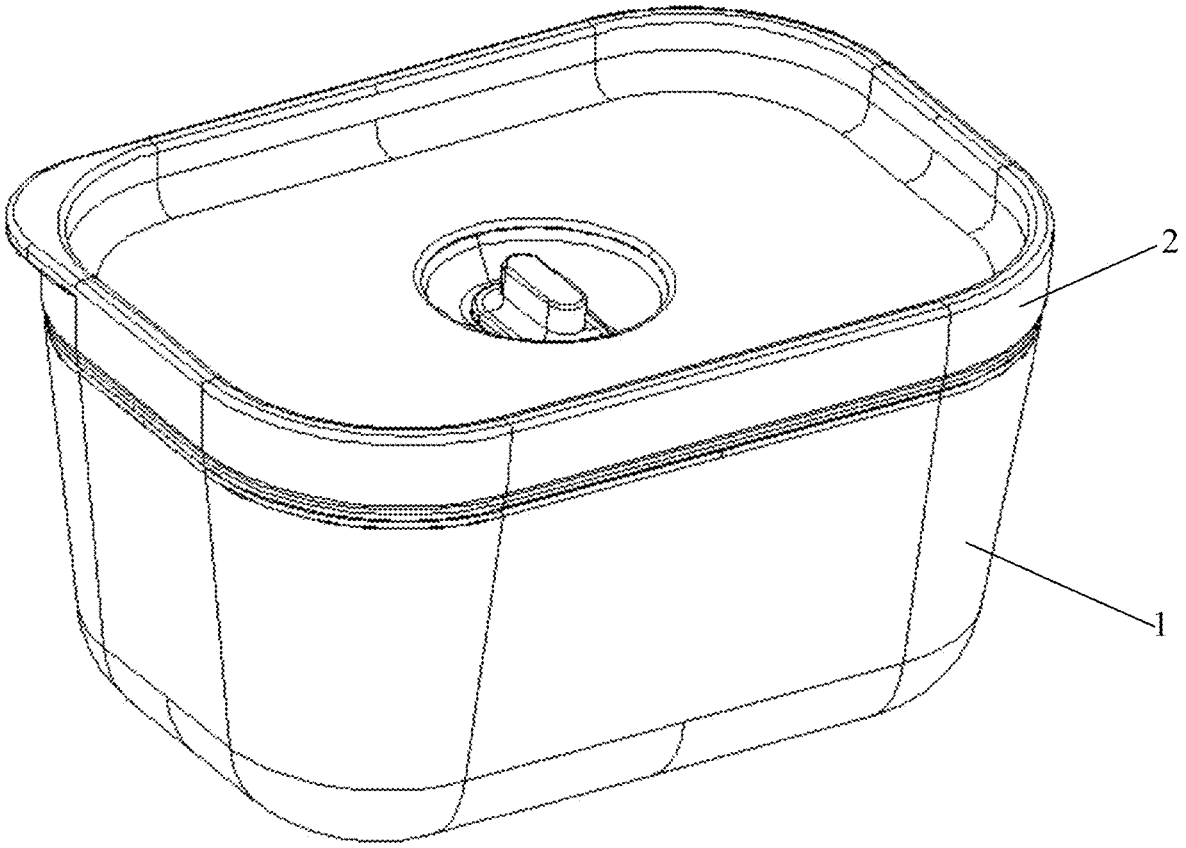
FIG. 1 is a three-dimensional structural schematic diagram of a box provided by the present invention.
Figure 2:
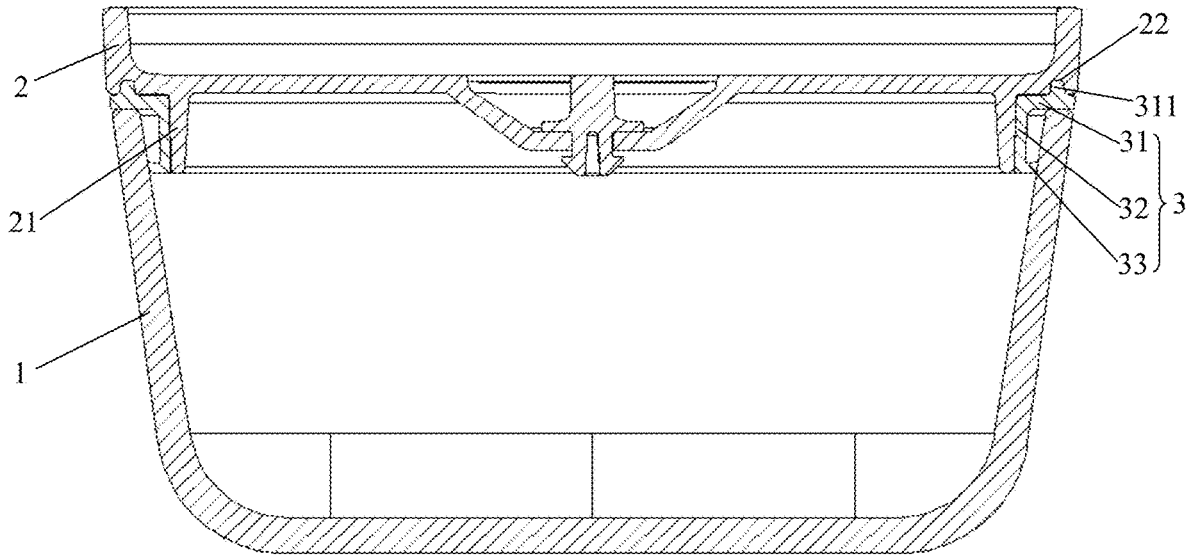
FIG. 2 is a front sectional structural schematic diagram of FIG. 1.
Figure 3:
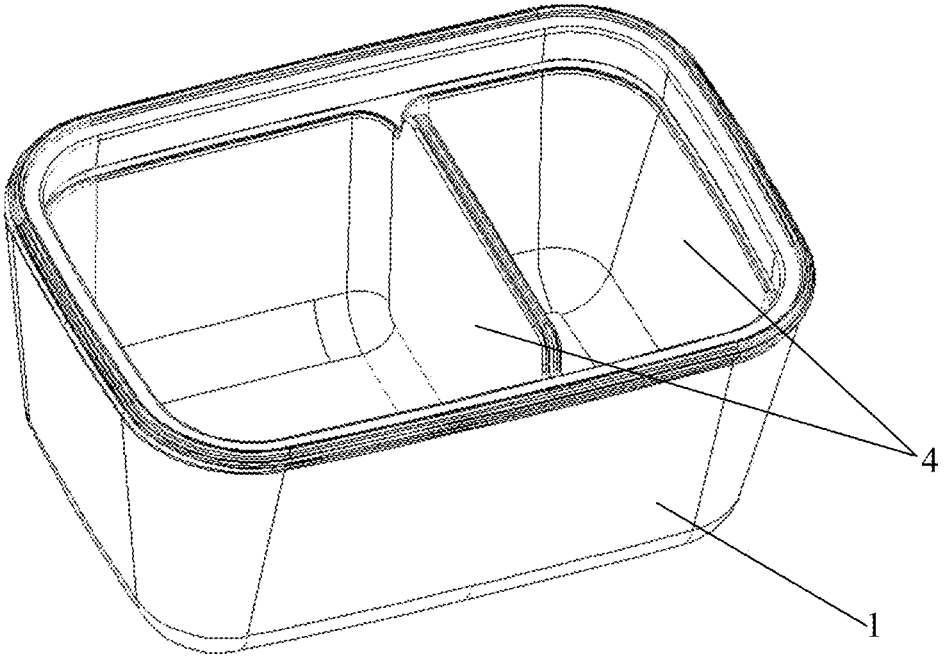
FIG. 3 is a schematic diagram in which a storage box is arranged in a box body.
Figure 4:
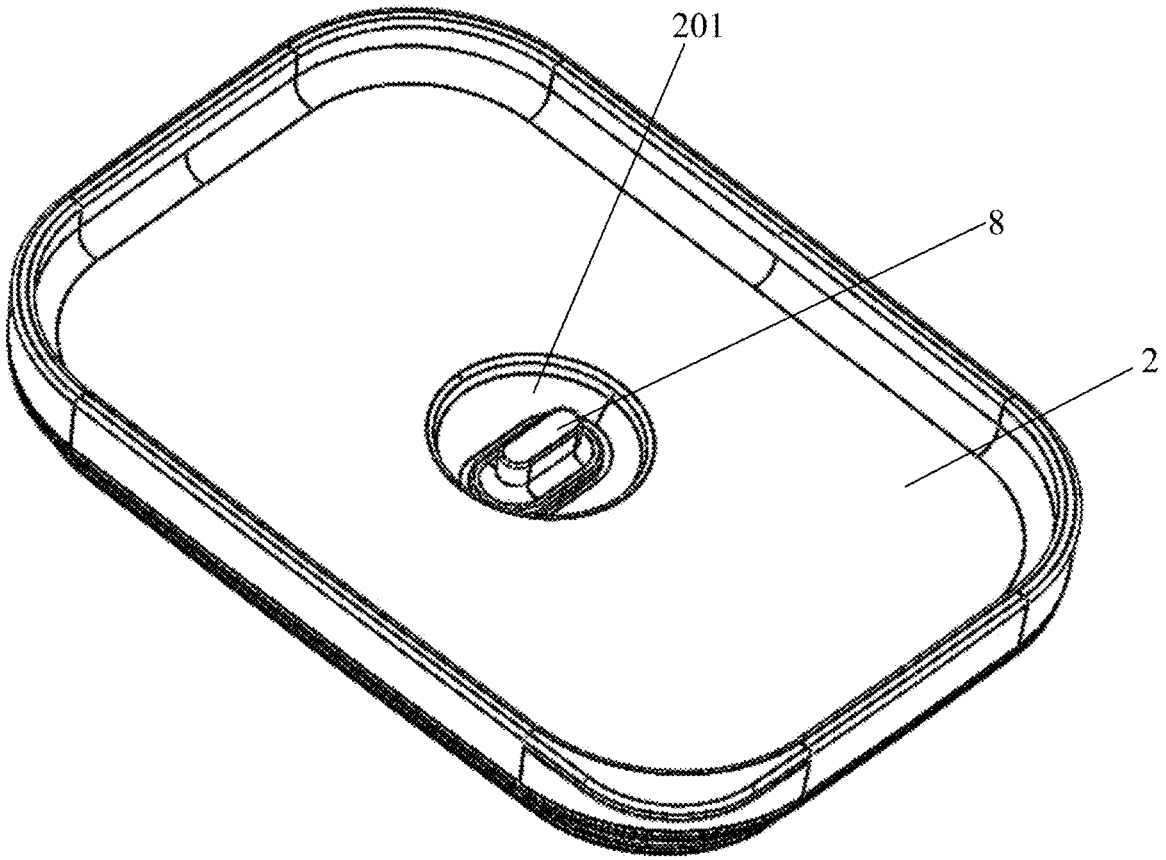
FIG. 4 is a schematic diagram in which a box cover is provided with an air hole lifting plug.
Figure 5:
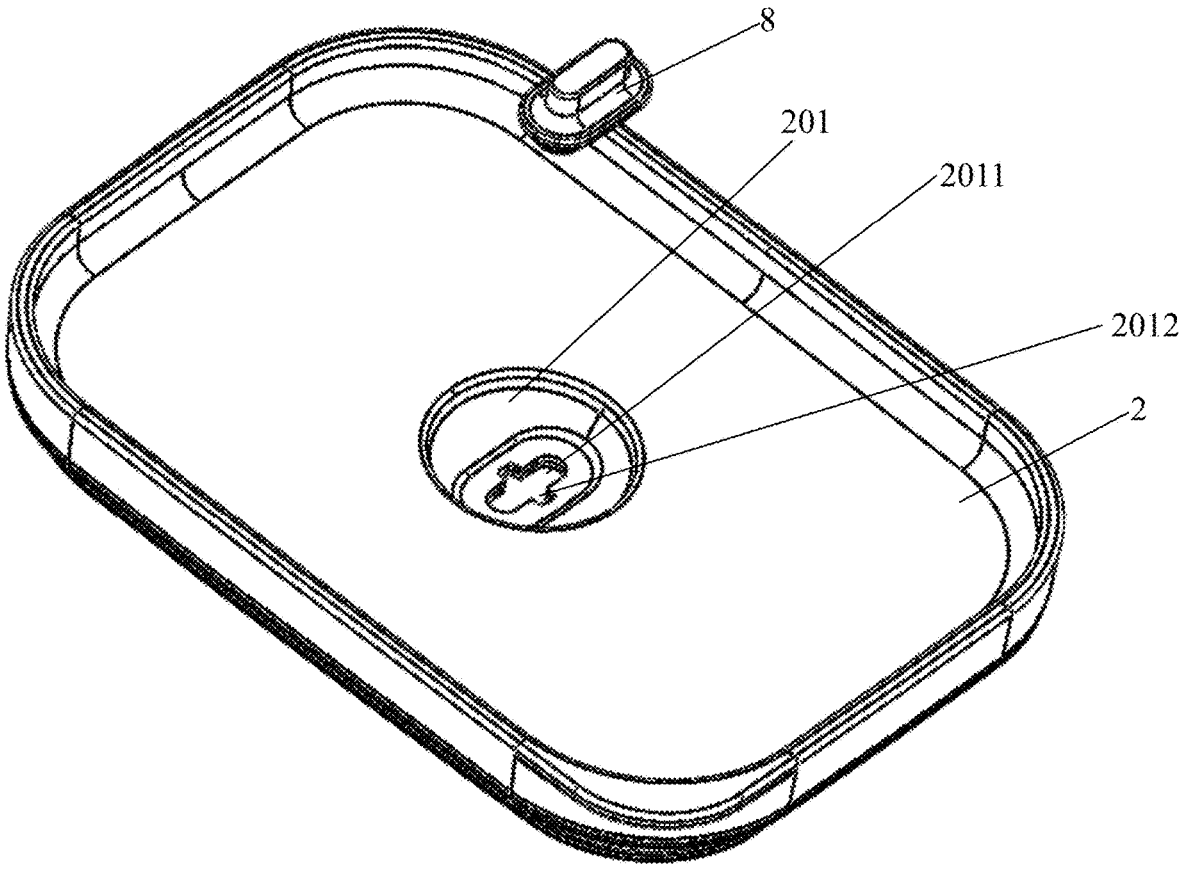
FIG. 5 is an exploded structural schematic diagram of FIG. 4.
Figure 6:
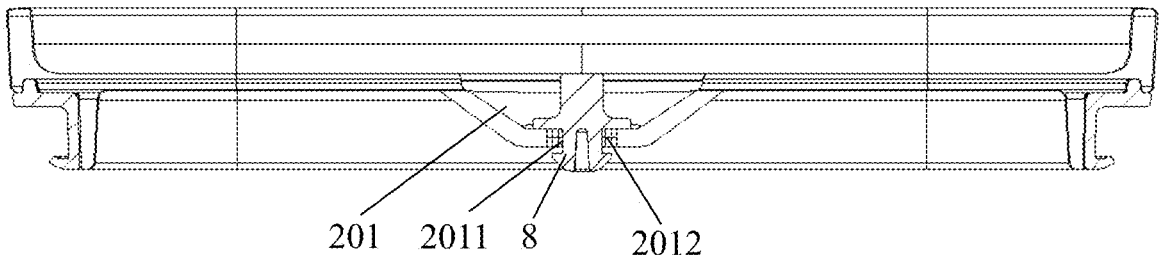
FIG. 6 is a front sectional structural schematic diagram of FIG. 4.
Figure 7:
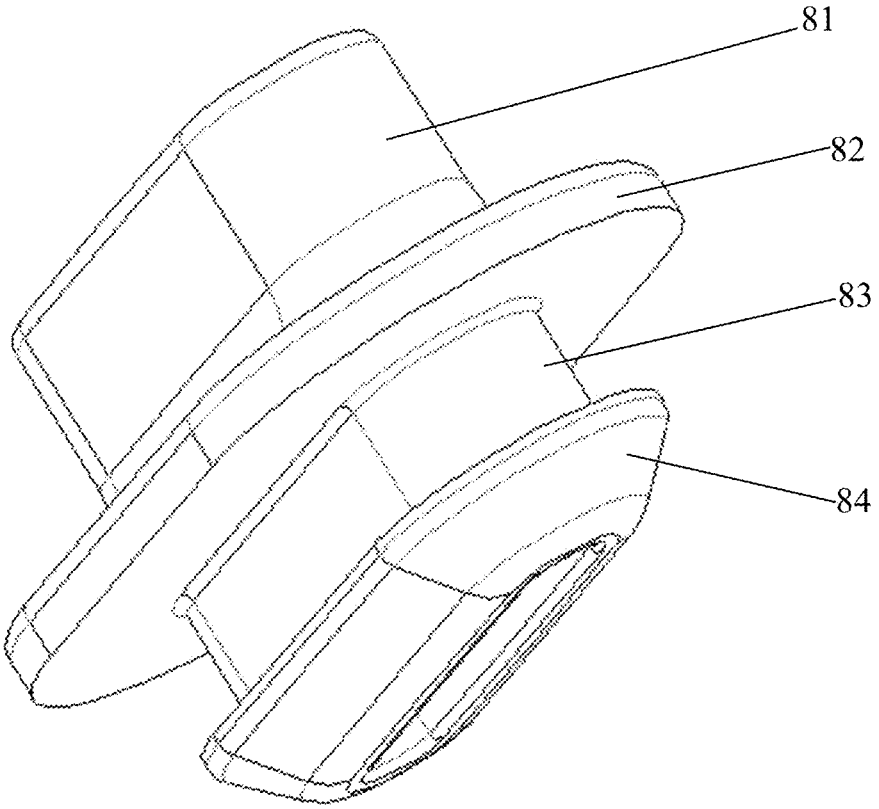
FIG. 7 is a three-dimensional structural schematic diagram of an air hole lifting plug.

As shown in FIG. 1-FIG. 7, embodiments of the present invention disclose a box, comprising:

a box body 1, wherein the top end of the box body 1 is open;

a box cover 2, wherein the box cover 2 is covered at an opening of the box body 1, a limiting cylinder 21 is formed on the bottom end of the box cover 2 near an outer edge, and the bottom end of the box cover 2 is provided with an annular clamping groove 22 located at the outer side of the limiting cylinder 21;

an elastic sealing ring 3 (which can adopt a silicone rubber ring) which comprises:

a top sealing ring 31, wherein the top sealing ring 31 is crimped between the open end of the box body 1 and the bottom end surface of the box cover 2, an inserting flange 311 is integrally formed at the top end of the top sealing ring 31, and the inserting flange 311 is clamped in the annular clamping groove 22;

a middle sealing cylinder 32, wherein the outer wall of a cylinder port of the top end of the middle sealing cylinder 32 is integrally connected with a ring port of the top sealing ring 31, and the middle sealing cylinder 32 is sleeved on the outer cylinder wall of the limiting cylinder 21;

a bottom sealing ring 33, wherein a ring port of the bottom sealing ring 33 is integrally formed and connected with the outer wall of the cylinder port of the bottom end of the middle sealing cylinder 32, and the outer edge of the bottom sealing ring 33 is in compression sealing contact with the inner wall of the box body 1.

In the embodiment, the box body 1 is made of plastics or stainless steel or glass.

By referring to FIG. 4-FIG. 7, the top end surface of the box cover 2 is provided with a concave accommodating groove 201, the groove bottom of the accommodating groove 201 is provided with an installing hole 2011 and a vacuuming vent hole 2012, and the vacuuming vent hole 2012 is located on one side of the installing hole 2011;

the box further comprises an air hole lifting plug 8 arranged on the installing hole 2011, and the air hole lifting plug 8 comprises:

a lifting block 81, wherein the lifting block 81 is arranged in the accommodating groove 201;

a sealing cover 82, wherein the top end of the sealing cover 82 is integrally formed and connected with the bottom end of the lifting block 81 and the bottom end of the sealing cover 82 and the groove bottom of the accommodating groove 201 are in tight sealed contact for sealing the vacuuming vent hole 2012;

a guide connecting block 83, wherein the guide connecting block 83 is penetrated in the installing hole 2011, the top end of the guide connecting block 83 is integrally formed and connected with the bottom end of the sealing cover 82, the bottom end of the guide connecting block 83 is integrally formed and connected with an anti-falling lug boss 84, and the anti-falling lug boss 84 is located below the bottom end surface of the box cover 2.

Firstly, the box of the present invention can be used as a storage box, a fresh-keeping box, a lunch box and a baking tray; and the bottom sealing ring in the box is in compression sealing contact with the inner wall of the box body as a first seal, and the top sealing ring is pressed between the box cover and the box body and serves as a second seal. Therefore, the elastic sealing ring of the box body can play a role of double seals to improve the sealing performance of the box body; and secondly, the box can be provided with storage boxes for placing different types of food in different regions, and can also be configured with a water filter with water filter function, which has multiple functions.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A box, comprising:

a box body, wherein a top end of the box body is open;

a box cover, wherein the box cover is configured to cover an opening of the box body, a limiting rib is formed on a bottom end of the box cover near an outer edge, and the bottom end of the box cover is provided with an annular clamping groove outside the limiting rib;

an elastic sealing ring which comprises:

a top sealing ring, wherein the top sealing ring is crimped between an open end of the box body and a bottom end surface of the box cover, an inserting flange is integrally formed at a top end of the top sealing ring, and the inserting flange is inserted in and connected with the annular clamping groove;

a middle sealing segment, wherein an outer wall of an opening of a top end of the middle sealing segment is integrally connected with a rim of the top sealing ring, and the middle sealing segment is fitted on an outer wall of the limiting rib;

a bottom sealing ring, wherein a rim of the bottom sealing ring is integrally formed and connected with the outer wall of the opening of a bottom end of the middle sealing segment, and an outer edge of the bottom sealing ring is in compressing sealing contact with an inner wall of the box body, wherein a top end surface of the box cover is provided with a concave accommodating groove, a groove bottom of the accommodating groove is provided with an installing hole and a vacuuming vent hole, and the vacuuming vent hole is located on one side of the installing hole to form a cruciform hole; and an air hole lifting plug arranged on the installing hole, wherein the air hole lifting plug comprises:

a lifting block, wherein the lifting block is arranged in the accommodating groove;

a sealing cover, wherein a top end of the sealing cover is integrally formed and connected with a bottom end of the lifting block and a bottom end of the sealing cover and a groove bottom of the accommodating groove are in tight sealed contact for sealing the vacuuming vent hole; and a guide connecting block, wherein the guide connecting block is penetrated in the installing hole, a top end of the guide connecting block is integrally formed and connected with the bottom end of the sealing cover, a bottom end of the guide connecting block is integrally formed and connected with an anti-falling lug boss, and the anti-falling lug boss is located below the bottom end surface of the box cover.

2. The box according to claim 1, wherein a plurality of storage boxes for classifying and containing food are placed in the box body.

3. The box according to claim 1, wherein a plate or basket type water filter is placed in the box body, and a bottom end of the water filter is provided with a plurality of supporting legs.

4. The box according to claim 1, wherein the box body is made of plastics or stainless steel or glass.

5. The box according to claim 4, wherein when the box body is made of glass, the box further comprises a silicone base, and the bottom of the box body is placed on the silicone base.

6. The box according to claim 5, further comprising an annular silicone band, wherein the annular silicone band is sleeved on the silicone base, the box body and the box cover, and used for fixing the silicone base and the box cover respectively to the bottom end and the top end of the box body.

7. The box according to claim 6, wherein an annular supporting flange is integrally formed at a bottom end of the silicone base, the annular supporting flange has a limiting avoidance gap, and the annular silicone band penetrates through the limiting avoidance gap.

8. The box according to claim 1, wherein the bottom end of the box cover is provided with a spoon for holding food or a ruler for determining the amount of food taken.

9. The box according to claim 8, wherein the bottom end of the box cover is provided with a clamping bulge, both of the spoon and the ruler are provided with clamping holes, silicone rings are fixed to the clamping holes, and inner holes of the silicone rings are clamped on the clamping bulge.

* * * * *